United States Patent [19]

Strumskis

[11] 4,325,787

[45] Apr. 20, 1982

[54] APPARATUS FOR RETORTING COMMINUTED OIL SHALE

[75] Inventor: Louis Strumskis, Ocala, Fla.

[73] Assignee: Georgia Oil and Gas Company, Ocala, Fla.

[21] Appl. No.: 173,944

[22] Filed: Jul. 31, 1980

[51] Int. Cl.[3] ..... C10B 1/04; C10B 53/06; C10B 57/06; C10B 57/12

[52] U.S. Cl. ..... 202/106; 201/33; 201/34; 201/36; 201/38; 202/121; 202/150; 202/221; 208/8 R; 208/11 R

[58] Field of Search ..... 202/106, 120, 121, 150, 202/127, 220, 221; 201/25, 33, 34, 36, 38; 208/8 R, 11 R; 366/309, 325, 329; 48/73, 78, 85, 123

[56] References Cited

U.S. PATENT DOCUMENTS

| | | | |
|---|---|---|---|
| 52,284 | 1/1866 | Gengembre | 196/14.52 |
| 229,599 | 7/1880 | Freeman | 366/325 X |
| 1,421,228 | 6/1922 | Heimbucher | 202/106 |
| 1,909,421 | 5/1933 | Parr et al. | 201/33 |
| 1,938,596 | 12/1933 | Karrick | 202/221 |
| 2,167,503 | 7/1939 | Gilles | 202/221 |
| 2,397,432 | 3/1946 | Records | 202/121 X |
| 2,478,295 | 8/1949 | Marecaux | 202/121 X |
| 2,698,283 | 12/1954 | Dalin | 208/11 R |
| 2,701,787 | 2/1955 | Hemminger et al. | 208/11 R X |
| 2,757,129 | 7/1956 | Reeves et al. | 202/121 X |
| 2,966,450 | 12/1960 | Kimberlin, Jr. et al. | 208/87 X |
| 3,038,643 | 6/1962 | Van Der Lely et al. | 366/325 X |
| 4,107,029 | 8/1978 | Lorenz | 208/11 LE |
| 4,161,441 | 7/1979 | Morrell | 208/11 R |
| 4,212,652 | 7/1980 | du Pont | 202/106 X |

*Primary Examiner*—Bradley Garris
*Attorney, Agent, or Firm*—Millen & White

[57] ABSTRACT

A continuously operable retort-type processing system for the recovery of petroleum-like products from comminuted oil-bearing shale and other oil-yielding particulate solid materials. The retort portion of the system includes an insulated retort outer shell for a wall jacket-type heat exchanger. Disposed within the retort, all driven from a common axially disposed motor-driven shaft, are a plurality of stirring fingers, wall scrapers and discharge shovels, the latter for use in discharge of spent solid material from the retort. The system envisions burning gases from the process to provide a fluid heat exchange medium as a source of the heat required for the process. The system further includes means for the admixture of steam and acetic acid with the starting particulate materials prior to its introduction into the retort. An additional instrumentality is included at an intermediate position along the reaction path of the materials as they pass through the retort for the addition of additional quantities of steam and acetic acid.

13 Claims, 4 Drawing Figures

APPARATUS FOR RETORTING COMMINUTED OIL SHALE

BACKGROUND OF THE INVENTION

This invention relates to a system incorporating retorting apparatus for ex situ processing of comminuted oil shale and other oil-yielding solid particulate materials to recover petroleum-like products therefrom.

Prior art systems for the extraction of oil from oil bearing solids have not in general been directed to the use of acetic acid in the process of operation thereof although the use of acetic acid for such purposes has been mentioned more to the negative than the positive aspects thereof. See Kimberlin et al., U.S. Pat. No. 2,966,450. The heating of solids in a retort by indirect heat exchange with a hot fluid also is not conventional.

U.S. Pat. Nos. 2,694,037 (Johnson et al.) and 4,058,205 (Reed) each disclose helical screw-type conveyors for moving fresh shale to a mixer or other treating apparatus. Reed discloses a preheater for preheating coal and shale immediately downstream of the first conveyor. U.S. Pat. No. 52,283 and U.S. Pat. Nos. 52,284 (Gengembre) and 2,073,367 (Fisher) all disclose a rotating shaft with stirring fingers that agitate material inside a cylindrical vessel. In the two Gengembre patents, the cylindrical vessel disclosed is of the retort type. U.S. Pat. No. 2,701,787 (Hemminger et al.) discloses a shale retort with a burner section in which the shale itself is burned. U.S. Pat. No. 4,104,537 (McQuitty) and U.S. Pat. No. 4,107,029 (Lorenz) each disclose a scraper at the bottom of a cylindrical vessel adapted to treat aqueous suspensions or slurries of tar sands or the like. U.S. Pat. No. 4,110,194 (Peterson et al.) and U.S. Pat. No. 4,189,376 (Mitchell) both disclose helical screw type conveyors for removing used particulate solids from the bottom of a treatment vessel. Peterson also discloses stirring fingers. Mitchell discloses means for injecting steam and solvent into different zones of the extraction vessel.

The system of the instant invention as aforementioned envisions a continuously operative system wherein crushed coal, oil shale, oil sands, wood, peat or the like are dumped from a dump truck into a receiving hopper for conveyance to a storage bin, from which bin it is then fed by an auger-type screw conveyor into the retort or silo where the separation process is effected. The apparatus incorporates inlets for acetic acid for use in the extraction process at the initial mixing and conveying stage as well as at at least one additional downstream location along the lower portion of a vertically oriented retort silo to provide for this introduction of additional acetic acid at an additional predetermined zone in the interior of the retort. Separation and continuous or periodic removal of the end products of the process together with the functioning of closed circuit systems for heat control, efficient use of hot gas, and use of steam both for heating and the admixing of acetic acid, facilitate the continuous operational nature of the apparatus.

It is a feature of the instant invention to provide a continuous retort system wherein a stream of solid particulate oil bearing or oil producing raw material is introduced into the top of a retort or silo reaction chamber where it is heated to successively higher temperatures, treated with steam and acted upon by acetic acid until petroleum-like oil products separate therefrom by volatilization into a gaseous mixture from which water and gaseous by-products are thereafter separated therefrom and solid waste material is removed from the lowermost portion of the retort.

It is an object of the invention to provide a continuously operable retort apparatus for obtaining petroleum-like products from shale or other oil-producing carbonaceous solids in a manner wherein the solid material from whence the oil products are desired to be extracted are subjected to a plurality of zones of increasingly varying temperatures as the solid products are mixed and conveyed through the retort apparatus towards the discharge outlet thereof.

In correlation with the foregoing object, it is a further object of the instant invention to incorporate in the heating in the system) heat exchange means which is provided for control of the temperature about the periphery of the material contained in the retort and which advantageously incorporates inlet and outlet ports, respectively, for the reception within the retort of gases utilized for heat transfer in the separation process and effective recovery and exhaust of hot spent gas for economical and highly efficient heat recirculation purposes.

It is a further object of the instant invention in correlation with the foregoing objects to provide agitation means within the retort or silo structure to facilitate mixing acetic acid and steam with the solid particulate material therein and for the prevention of caking of the solid particulate material as it moves through the retort by gravity.

Another object of the invention resides in the provision, in a continuously operable retort apparatus, of means for the introduction of acetic acid for enhancement of the yield of petroleum-like products from shale or other oil bearing or oil producing carbonaceous solids.

In correlation with the foregoing object, it is a further object of the instant invention to incorporate in conjunction with the steam and acetic acid introduction system, heat exchanger means for the control of the temperature within the retort which advantageously incorporates heat exchangers at the solids inlet and outlet ports.

Another object of this invention is the provision of a continuous running retort apparatus which includes means for the prevention of caking of the particulate material on the inner wall of the retort. Other advantageous benefits reside in the non-polluting character of the apparatus and the higher yields of oil than conventional retorting systems.

A still further object of the instant invention is to provide an environmentally acceptable system for the production of oil products from oil bearing and other oil producing carbonaceous solid materials.

A further object resides in the provision of a continuous-running trouble-free silo system in which the material to be processes is heated gradually so that the oil products are discharged from the retort as they are formed and are not decomposed by excessive heating after they are formed.

SUMMARY OF THE INVENTION

In one aspect, this invention is a continuously operable retort-type processing system for recovery of petroleum products from comminuted oil shale and like solid particulate oil-yielding raw material, comprising in combination a double walled retort means providing a heat exchange jacket between the walls; feed means for the introduction of a stream of particulate solid raw material into the upper portion of the retort; heat exchanger preheating means for indirectly preheating the particulate solid material before it enters the retort; discharge means for discharging spent solids from the bottom portion of the means for discharging gaseous products from the retort means; condenser means for condensing volatilized liquids from the gaseous products discharged from the retort; stirring means disposed at spaced intervals in a radially projecting array on longitudinally separated axially disposed vertical portions of the shaft and adapted for stirring of particulate solid material in the retort; heating means for supplying a heated fluid to the lower portion of the heat exchange jacket and withdrawing the fluid from the upper portion thereof, whereby particulate material in the retort is indirectly heated therewith to progressively increasing temperatures as the particulate material passes through the retort; and steam injection means for admixing steam with the particulate material both in the heat exchanger preheating means and in the retort before reaching the bottom of the retort.

DESCRIPTION OF THE DRAWINGS

Other objects, features and many of the attendant advantages of this invention will be readily appreciated as the same becomes better understood by reference to the accompanying drawings wherein.

DETAILED DISCUSSION

Figure 1:
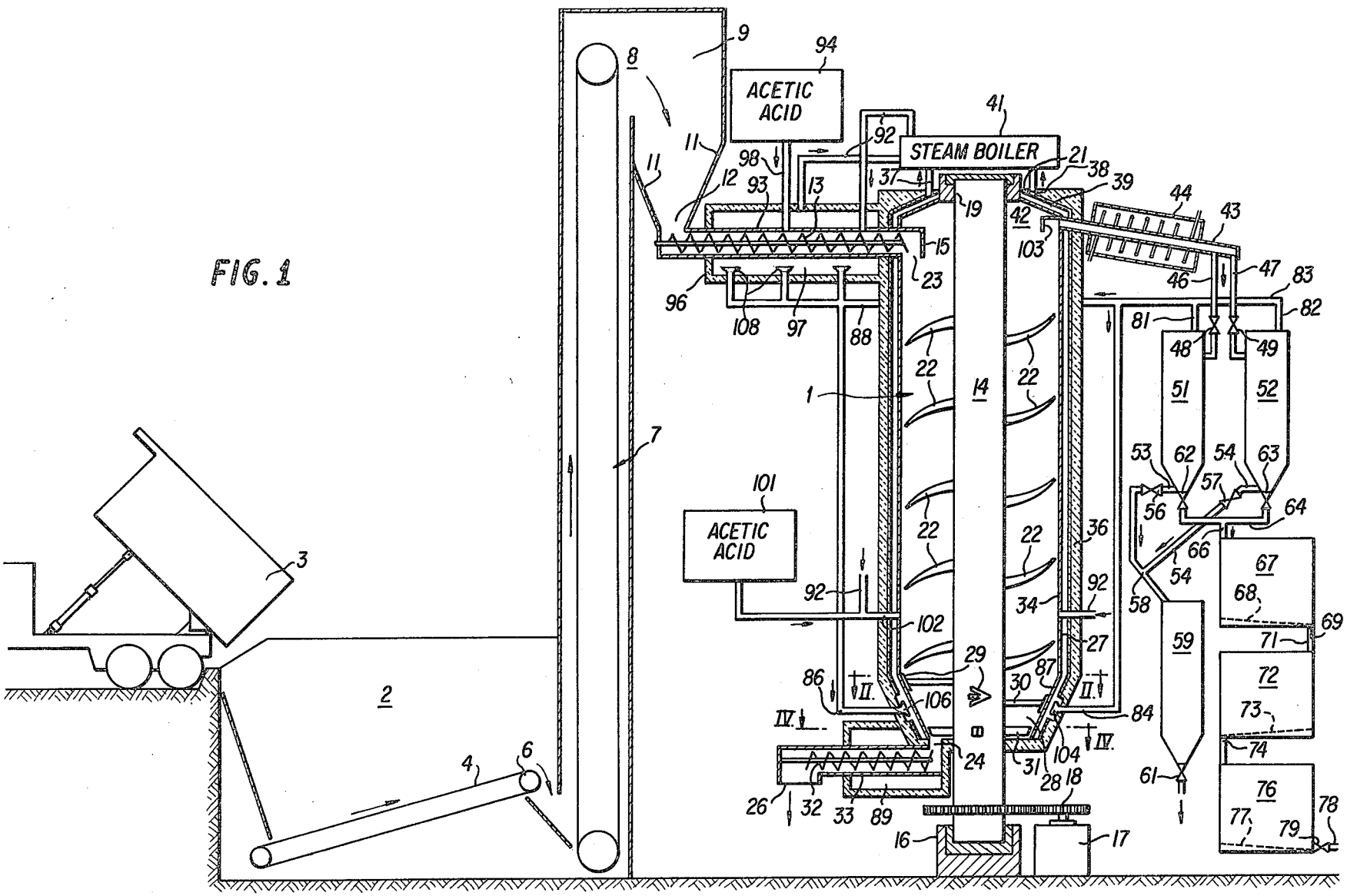
FIG. 1 is a generally diagrammatic illustration of the apparatus of the system with parts thereof indicated in vertical section, of the retort and discharge apparatus associated therewith.

Referring now to the drawings and more particularly to FIG. 1 thereof, a preferred embodiment of the overall system of the invention is shown therein, the principle unit of which is a vertically disposed retort silo assembly generally indicated at 1. The apparatus associated therewith includes a receiver hopper 2 of any suitable nature for reception of the starting particulate raw material which may be unloaded as for example from a dump truck shown at 3. The crushed oil shale or the like as deposited in the hopper 2 is conveyed therefrom by an endless belt type conveyor of a conventional nature as indicated at 4 and which may be of any suitable type such as of a bucket or plate flight character, as welll known in the art. The discharge end of the conveyor at 6 is in proximity to the vertically disposed endless belt type elevator 7 which provides communication generally from the hopper 2 to a discharge end indicated at 8.

The elevator discharges raw material and dumps it into bin 9. The lowermost inclined surfaces 11 of bin 9 discharges at the bottom 12 thereof into an auger screw type feed conveyor 13. Conveyor 13 provides communication between the discharge opening of the bin 9 and the interior of the retort 1 and baffle plate 15 diverts the raw material downwardly into the retort. The retort chamber in which the crushed shale is received includes a vertically disposed hollow shaft 14 which is mounted in a mercury bearing 16 disposed at the lower end thereof. The shaft is driven in any suitable manner such as for example as shown at the base thereof by a steam or electric motor 17 and any suitable type drive mechanism, indicated diagrammatically at 18. Steam for driving the motor 17 can be supplied by a steam boiler 41, described hereinafter. An upper bearing 19 for the vertical shaft 14 is disposed as indicated at 21. Disposed at periodic intervals along the linear extent of the vertical shaft 14 in the retort 1 are a plurality of horn-like arcuately shaped stirring fingers 22 which are disposed to continuously agitate the shale and enhance migration of the crushed shale from the upper intake portion or zone of the retort at 23 to the retort spent solids discharged orifice outlet thereof at 24. This function is additionally aided by gravity as the material is drawn off at the discharge outlet of the system at 26. The particulate material within the retort migrates towards this discharge outlet and hence the reactions within the retort are of a continuous nature and extraction of the desired products of petroleum and other by-products of the chemical reactions carried out therein are of a progressive nature as the material moves downwardly through the interior of the retort 1. The lower portion of the retort housing is of generally frustro-conical configuration as shown at 28 whereby a plurality of scraper blades 29 mounted on positioning shafts 30 disposed at the lower portion of the shaft 14 effect scraping movement against the inner wall 87 of lower portion 28 of the retort. A plurality of discharge shovels 31, disposed immediately above the retort spent solids discharge outlet 24, direct the spent solids thereto. The materials falling through the spent solids discharge outlet at 24 are engaged by a screw type auger conveyor 32 within the housing 33 for movement horizontally to a conveyor discharge outlet at 26 for discharge of the material in any suitable manner as by feeding to other conveyors, elevators or into the bed of dump trucks or railway hopper cars, as desired.

The retort 1 is comprised of means providing a dual wall structure for providing heat exchange functions from hot combustion gases passed between the spaced chamber walls 27 and 34 thereof and the particulate material contained within the retort. The external surface of the retort is covered by a layer of insulation indicated generally at 36.

Figure 2:
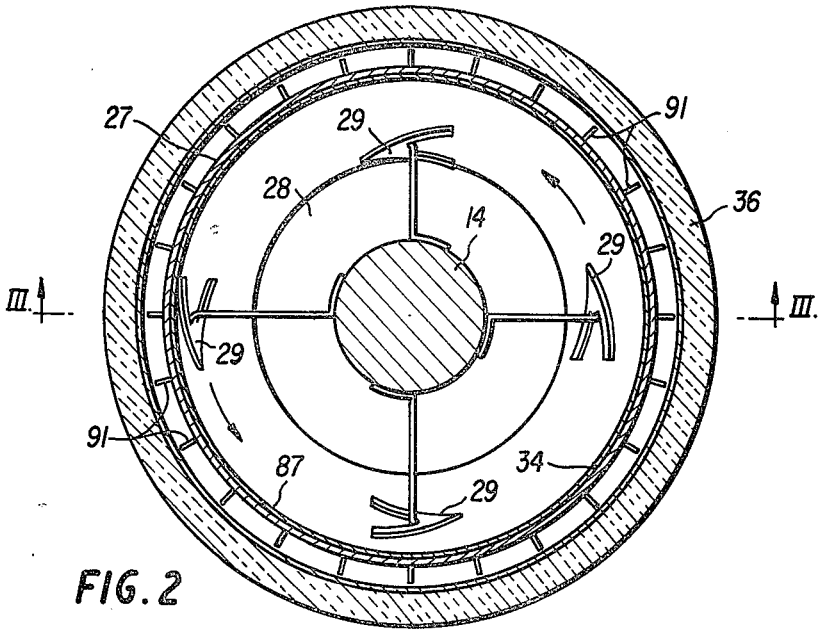
FIG. 2 is a fragmentary sectional view in plan taken along the line II—II of FIG. 1 and showing details of the relationship between the scraper arm and the interior of the retort.
Figure 3:
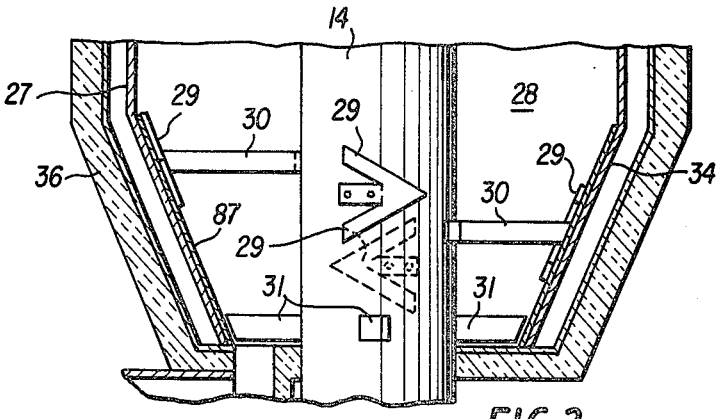
FIG. 3 is a fragmentary view in elevation at an enlarged scale taken along the line III—III of FIG. 2 and showing additional details of the scraper arms.
Figure 4:
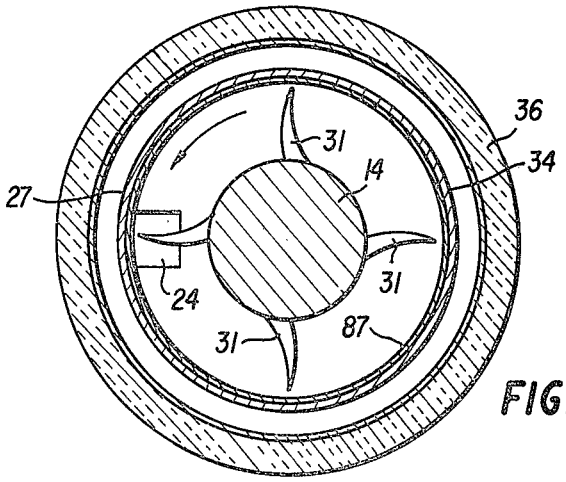
FIG. 4 is a fragmentary view in plan of the details of the discharge shovels as taken along the line IV—IV of FIG. 1.

The heated walls distribute the heat throughout the outer parts of the retort chamber as shown by the details of FIGS. 2 and 3. Heat recovery fins 91 may be made of copper and tied to a ring around the silo 1 for better heat recovery.

The outer shell metal 27 may be made of steel and insulated with a suitable insulating material 36.

The upper end of the heat exchange jacket formed by walls 27 and 34 is connected by conduits at 37 and 38 to provide fluid communication from the upper end of the heat recovery area of the retort at 39 to the outer shell of a steam boiler, shown schematically at 41, disposed above the upper bearing assembly 19 of the retort 1. The boiler is illustrated as being placed on top the silo in such a manner as to utilize the escaping hot gases for heat recovery and greatest efficiency in the use of BTU's. The gaseous products which pass upwardly into the upper chamber area 42 of the retort 1 are carried off by outlet conduit 43 and passed through a condenser 44 of a character well known in the art to a plurality of discharge conduits shown for example as 46 and 47. Suitable valve arrangements 48 and 49 are provided in the conduits 46 and 47 for controlling the flow of condensed liquid into a pair of collector and separator tanks 51 and 52. The lower end of the collector and separator tanks 51 and 52 are of a conical configuration and fitted above but proximate thereto are a pair of discharge conduits 53 and 54, respectively, each having a valve 56 and 57, respectively; and connected to each other by a "Y" connection at 58 for discharge into crude oil storage tank 59.

Phase separation in tanks 51 and 52 can be facilitated by providing them with cooling jackets (not shown) to further cool the liquids condensed in condenser 44 and/or by the use of centrifuges (not shown) in lieu of or in conjunction with tanks 51 and 52, which collect the distilled liquid and separate the same by action of the respective specific gravities into crude oil which is discharged at outlets 53 and 54 and dirty water which discharges at their lowermost points into conduit 64. The crude oil storage tank 59 also has a conical configuration at the lower end thereof and is fitted with a suitable discharge valve 61 disposed at its outlet for controlled discharge of the crude oil contained therein to a suitable dispensing conduit (not shown). Fitted at the bottom of tanks 51 and 52 are a pair of valves 62 and 63, respectively, which control the flow of dirty water from the lowermost point of the conical tanks 51 and 52. A "U"-shaped conduit 64 provides fluid communication from valves 62 and 63 via conduit 66 to a dirty water collection tank 67. The lower portion of the dirty water tank 67 is provided with an inclined bottom 68 which is elevated at the end remote from the discharge end 69 for flow from the discharge outlet tube 71 to a limestone briquette water neutralizer tank 72 of a construction similar to that of the dirty water tank 67. The tank 72 also has an inclined bottom at 73 for enhancing flow to the discharge outlet tube 74 which in turn is connected to an activated charcoal filter tank unit 76.

The collected dirty water at 67 is run through limestone briquettes (not shown) in chamber 72 to remove acidic elements and suspended solids therefrom. When the limestone is neutralized, it may be removed from tank 72 in order to extract water soluble materials, such as acetone, alcohol and acetic acid, therefrom. The inclined bottom 77 of tank 76 discharges into an effluent conduit 78 which is in turn controlled by the valve 79 and optionally is connected via pumping means (not shown) to the water inlet of steam boiler 41. A centrifuge (not shown) can be disposed between conduit 66 and tank 67 to remove any solids suspended in the dirty water.

The upper ends of tanks 51 and 52 are each connected to a gas venting conduit 81 and 82, respectively, through which the combustible gases vented therefrom are transported through conduit 83 to gas inlet conduits 84, 86 and 88, which are connected to a plurality of conventional gas burners, two of which (104, 106) are disposed adjacent to tapered bottom portion of the retort adjacent the scraper assemblies, in the interior of the spaced heat exchange chamber between walls 34 and 27, thereby to provide heating of the particulate material contained in the retort at various levels or zones thereof, and others of which (108) are disposed in housing 96 of the preheat chamber 97 described hereinafter, to preheat the particulate material before it enters the retort. Alternatively, conduit 83 can be connected to suitable gas storage tanks (not shown) and commercially available natural gas can be used in lieu of, or in combination with, the vented gases to fuel the gas burners. In full operation, sufficient gas is generated from oil shale to provide all the requisite heat for the process. In the case of lignocellosic products, a portion of the heat can be supplied by burning the carbonaceous residue, either as produced or after use to clean the dirty water produced in the process.

The interior of the retort heat exchanger portion is provided with a copper lining at 87 as shown at the frustoconically shaped lower portion thereof for more efficient heat exchange. The housing 33 of discharge conveyor 32 is enclosed by a chamber generally indicated at 89 for heat recovery purposes.

The steam boiler 41 is shown as being connected to a steam distribution system generally indicated at 92 whereby steam is fed into the interior of retort 1 by conduit 102 and to the interior of the housing 93 surrounding the conveyor 13 which is connected between the bin 9 and the interior of the retort at or adjacent discharge port 23. The outer housing 96 also provides a preheat chamber at 97, in fluid connection via conduit 88 to gas venting conduits 81 and 82.

In the embodiment shown, housing 93 of heat exchanger housing 96 is also connected to a first acetic acid storage tank 94 whereby acetic acid is carried from the outlet 98 of the tank into the interior of the housing 93 for admixture along with the steam with the particulate raw material as it moves through the feed auger conveyor 13 to the retort. An additional acetic acid dispensing tank 101 and the steam distribution system 92 are connected for fluid communication of steam and acetic acid with a lower portion of the retort by virtue of an inlet conduit 102 which passes through the walls 27 and 34 of the retort.

A shield 103 is disposed at the entrance to outlet conduit 43 to prevent any particles of raw material from entering the outlet 43. The weight of the raw material in holding bin 9 prevents the rearward escape of any gases from conveyor 13.

All metal portions of the system which are contacted with the acetic acid must be of a non-corrosive material. This includes the metal wall 34 of the retort silo 1, wall 82, hollow shaft 14, housing 93 and baffle plate 15 of conveyor 13.

In operation, solid particulate raw material, such as crushed shale, is carried from the receiver hopper 2 through the instrumentalities of the inclined conveyor 4, the vertical elevator 7 to the dispensing bin 9. It is then drawn into conveyor 13, where it is mixed with acetic acid from storage tank 94 and preheated, preferably to about 100° C., by the hot combustion gases from gas burners 108 formed in preheat chamber 97, and with steam from steam boiler 41. The steam from steam boiler 41 not only distributes the acetic acid evenly but also serves to moisten the particulate material for more efficient transfer of heat. It is essential in the practice of the invention to preheat the incoming material, not only to commence the cleaning of kerogen in shale and initiate gasification, but also to prevent the condensation of those outgoing gases by otherwise cold material being introduced into the retort chamber at 23.

Hot combustion gases entering the system from gas burners 104 and 105 also heat walls 34 and 87 of the retort, preferably sufficiently to heat the particulate material to about 500° C. at the bottom of the retort and to successively lower temperatures at successively higher points in the retort, preferably so that the particulate material at the top of the retort is heated to about 110° C.

As the solid particulate matter enters the retort at 23 and passes downwardly therethrough, it is stirred by stirring fingers 22. The design of the stirring fingers 22 simulates in shape a bull's horn, which facilitates the advance thereof through the particulate material by thrusting the pointed and sharp surface thereof in advance of the larger dimensioned base portion thereof. Such a design offers the least resistance to movement together with the greatest stirring benefits possible. In fact, the stirring may stop and go even if the silo is full of material. It is to be understood however that stirring of the material is necessary for a more even heating of the material, to prevent "caking" and additionally to provide a more advantageous and easier release of the gaseous products.

When the particulate matter reaches the frusto-conical portion 28, it contacts wall 87 which is extremely hot in order to bring the particulate matter to its highest temperature. There is therefore a strong tendency of the particulate matter to form an insulating layer on wall 87. This is avoided by rotating scraper blades 29.

When the particulate matter reaches the bottom of the retort, it is directed by discharge shovels 31 toward outlet 24. The discharge shovels 31 rotate constantly with the main shaft 14 to drive the spent material into the discharge screw conveyor 32, which may be made to rest inside grooves (not shown) in the discharge tubing of orifice 24 in order to prevent any outside air from entering the interior of the retort chamber. It is additionally to be understood that the insulated heat recovery chamber 89 surrounding the discharge tubing at 24 can be utilized to produce steam in order to feed the drive unit motive power prime mover 17, if desired.

The main steam and acetic acid applications optionally can be accomplished in spurts rather than continuously to meet the desired quantity requirements for acetic acid utilization in the separation process.

The gaseous products released from the particulate matter by the combined action of the acetic acid, steam and heat are discharged into conduit 43 and through condenser 44, where vaporized liquids are condensed and discharged through conduits 46 and 47 into separator tanks 51 and 52, where the lighter oily products are separated from the aqueous layer and the residual gases, comprising methane, butane and nitrous oxide, are discharged from vent 80. These gases are used as fuel for the gas burners 104, 106 and 108.

The oily products are collected, preferably after centrifugation to separate suspended solids, in storage tank 59 and withdrawn therefrom as desired through discharge valve 61 for conventional refining. The aqueous layer is withdrawn from separator tanks through discharge valves 62 and 63 through conduit 64 to an appropriate purification system, such as the limestone 72 and activated charcoal 76 systems of the embodiment of the drawings. Preferably, valuable suspended solid organics are recovered from the aqueous phase before the aqueous layer enters tank 72, e.g., by centrifugation. Dissolved organics can be recovered periodically from tanks 72 and 76.

Other particulate solid hydrocarbonaceous and lignocellulosic materials, e.g., bituminous coal, tar sands, peat, saw dust, leaves, etc. can be employed instead of oil bearing shale as raw material processed in the apparatus of this invention.

What is claimed is:

1. A continuously operable retort-type processing system for recovery of petroleum products from comminuted oil shale and like solid particulate oil-yielding raw material, comprising in combination: a heat exchange jacket for heating the retort by indirect heat exchange; insulation means for insulating the retort; feed means for the introduction of a continuous stream of particulate solid raw material into the upper portion of the retort; heat exchanger preheating means associated with the feed means for indirectly preheating the stream of particulate solid material before it enters the retort; discharge means for discharging spent solids from the bottom portion of the retort; means for discharging gaseous products from the retort; condenser means for condensing volatilized liquids from the gaseous products discharged from the retort; stirring means, mounted on a driven shaft and disposed at spaced intervals in a radially projecting array located along the length of the shaft, and on longitudinally separated axially disposed vertical portions of the shaft, adapted for stirring of particulate solid material in the retort and enhancing migration of the material from the intake to the spent solids outlet; heating means for supplying a heated fluid to the lower portion of the heat exchange jacket and withdrawing the fluid from the upper portion thereof, whereby a stream particulate material in the retort is indirectly heated therewith to progressively increasing temperatures as the particulate material passes downwardly through the retort; steam injection means for admixing steam with the stream of particulate material both in the heat exchanger preheating means and in the retort before reaching the bottom of the retort; and acetic acid injection means wherein said acetic acid injection means comprises a source of acetic acid and means for admixing acetic acid with the stream of particulate material in the retort before the latter reaches the bottom of the retort.

2. The processing system of claim 1 further comprising heat recovery means for recovering heat from the heated fluid withdrawn from the heat exchange jacket.

3. The processing system of claim 1 further comprising a steam boiler; means for transfering steam from the steam boiler to the steam injection means; and means for heating water in the steam boiler with the heated fluid withdrawn from the retort.

4. The processing system of claim 1 wherein said heating means comprises a plurality of gas burners providing hot combustion gases as the heated fluid and means for recycling the gaseous products to the gas burners as fuel therefor.

5. The processing system of claim 1 wherein said acetic acid injection means further comprises means for introducing the acetic acid into the solid particular raw material before the latter enters the retort.

6. The processing system of claim 1 wherein the stirring means disposed on the shaft comprises in combination a plurality of stirring fingers; a plurality of wall scraper blades positioned below the stirring fingers proximate the bottom of the retort; and a plurality of discharge shovels positioned below the wall scraper blades at the bottom of the retort and adjacent to the spent solids discharge means.

7. The processing system of claim 1 wherein the stirring means disposed on the shaft comprises a plurality of scraper blades formed from a pair of tines joined at one end to form a V whose point forms the leading edge of the blade and one face of which is in sliding contact with the lower portion of the inner wall of the retort, adjacent the spent solids discharge means.

8. The processing system of claim 1 wherein the heating means comprises a gas burner for supplying hot combustion gases as the heated fluid to the lower portion of the heat exchange jacket of the retort.

9. The processing system of claim 6 wherein said heating means comprises a plurality of gas burners providing hot combustion gases as the heated fluid and means for recycling the gaseous products to the gas burners as fuel therefor; a steam boiler; means for transferring steam from the steam boiler to the steam injection means; and means for heating water in the steam boiler with the combustion gases withdrawn from the retort.

10. The processing system of claim 9 wherein the scraper blades are formed from a pair of tines joined at one end to form a V whose point forms the leading edge of the blade and one face of which is in sliding contact with the lower portion of the inner wall of the retort, adjacent the spent solids discharge means.

11. The processing system of claim 1 wherein the retort is double walled and provides a heat exchange jacket between the walls.

12. The processing system of claim 1 wherein said stirring means comprises a plurality of bull horn shaped stirrers disposed vertically along the entire length of the shaft.

13. The processing system of claim 12 wherein each one of said plurality of bull horn shaped stirrers are attached to said shaft at the wider end thereof and is curved so as to slide along the walls of the retort through the particulate solid material.

* * * * *